US007495575B2

(12) United States Patent
Tomzik et al.

(10) Patent No.: US 7,495,575 B2
(45) Date of Patent: Feb. 24, 2009

(54) GEAR PUMP

(75) Inventors: Arkardiusz Tomzik, Bergisch Gladbach (DE); Florian Axmann, Stuttgart (DE); Michael Baumann, Flein (DE)

(73) Assignees: Saurer GmbH & Co. KG, Mönchengladbach (DE); Dürr Systems GmbH, Bietigheim-Bissingen (DE)

( * ) Notice: Subject to any disclaimer, the term of this patent is extended or adjusted under 35 U.S.C. 154(b) by 214 days.

(21) Appl. No.: 11/263,358

(22) Filed: Oct. 31, 2005

(65) Prior Publication Data

US 2006/0120856 A1 Jun. 8, 2006

(30) Foreign Application Priority Data

Oct. 29, 2004 (DE) ..... 10 2004 052 558

(51) Int. Cl.
*G08B 21/00* (2006.01)

(52) U.S. Cl. ..... 340/686.3; 340/686.2; 340/611; 340/614; 340/626; 340/693.5; 340/693.9; 415/121.3; 415/122.1; 415/170.1; 418/178; 418/278; 418/206.9

(58) Field of Classification Search ..... 340/568.6, 340/611, 626, 648, 686.2, 686.3, 693.5, 693.9, 340/693.12, 614; 415/121.3, 122.1, 170.1; 418/178, 278, 206.9
See application file for complete search history.

(56) References Cited

U.S. PATENT DOCUMENTS 3,309,998 A 3/1967 Polaski
4,534,717 A * 8/1985 McCabe et al. ..... 418/181
5,253,988 A * 10/1993 Hunziker et al. ..... 418/1
5,549,462 A 8/1996 Mischler et al.
6,158,997 A * 12/2000 Post ..... 418/206.9
6,171,089 B1 * 1/2001 Oehman, Jr. ..... 418/75
6,283,734 B1 * 9/2001 Blume ..... 418/1
2004/0237154 A1 11/2004 Hezel et al.

FOREIGN PATENT DOCUMENTS

DE 92 15 104 U1 1/1973
EP 1 164 293 A2 12/2001

(Continued)

OTHER PUBLICATIONS

The Examination Report for European Patent Application No. 05 022 993.9, dated Jun. 6, 2008.

*Primary Examiner*—Hung T. Nguyen
(74) *Attorney, Agent, or Firm*—Alston & Bird LLP

(57) ABSTRACT

A gear pump for the dosed conveyance of pigmented lacquers or paints and which is adapted for use with a painting robot. The gear pump comprises two toothed wheels meshing with one another and which are mounted within a pump housing in such a manner that they can be rotated by a driven drive shaft and a fixed bearing shaft. For this, the drive shaft is mounted by a bearing section at multiple points in a pump housing and a coupling section of the drive shaft projects out of the pump drive to connect to a drive. In order, on the one hand, to avoid wear due to high pressure forces and, on the other hand, to absorb a pronounced load from the outside, a supporting bearing for the radial and axial support of the drive shaft is formed on the drive shaft's coupling section projecting outside of the pump housing.

12 Claims, 3 Drawing Sheets

FOREIGN PATENT DOCUMENTS

| | | | |
|---|---|---|---|
| EP | 1 447 183 | A1 | 8/2004 |
| JP | 07080366 | | 3/1995 |
| JP | 2000009051 | | 1/2000 |
| WO | WO-99/40324 | A1 | 8/1999 |
| WO | WO 01/16465 | A1 | 3/2001 |

* cited by examiner

GEAR PUMP

BACKGROUND OF THE INVENTION

The invention relates to a gear pump for the dosed conveyance of pigmented lacquers or paints.

A gear pump according to this class is known from EP 1 164 293 A2.

The known gear pump comprises two toothed wheels meshing in one another which are mounted within a pump housing in such a manner that they can rotate. Therein, one of the toothed wheels is held on the circumferential face of a drive shaft which is mounted at several bearing points within the pump housing. A coupling section of the drive shaft projects out of the pump housing in order to connect to a drive. Within the pump housing a rinsing duct system is formed whereby rinsing of the gear pump with a rinsing agent is possible. With this, the pigment remnants collected within the pump housing can be quickly and easily rinsed out during a change-over of paints.

The known gear pump is used in paint atomization devices for the painting of components, for example, of parts of motor vehicles. In order to treat complex components within a painting device, it is a known practice to use painting robots which hold an atomizing device on a robot arm.

A painting robot of this type is, for example, known from EP 1 447 183 A1. Here the painting nozzle devices held on a robot arm must be formed to be as compact as possible. In addition to this, constantly changing acceleration forces act on the device due to the motion of the robot arm. In order to keep the expenditure in lines as low as possible, it is customary to combine painting pumps directly with an atomization unit in order to obtain one structural unit in a robot arm. The known gear pump is, however, essentially designed for a stationary installation space in which no significant loads from the environment act on the gear pump.

It is an objective of the invention to provide a gear pump of the type described above which is suitable in particular for the dosed conveyance of pigmented lacquers or paints in a painting robot.

A further object of the invention lies in providing a gear pump which also conveys pigmented lacquers or paints at high operating pressures.

SUMMARY OF THE INVENTION

The above and other objects and advantages of the invention are achieved by a gear pump wherein the internal pressing forces, as well as the forces acting on the drive shaft from outside, can advantageously be absorbed outside of the pump housing by a separate supporting bearing. For this purpose, on the drive shaft's coupling section projecting outside of the pump housing, the supporting bearing is formed for the radial and axial support of the drive shaft. By means of the axial support of the drive shaft the pressing forces acting on the drive shaft can advantageously be absorbed so that the toothed wheel fastened to the drive shaft on the front faces can be guided to the pump housing in such a manner that there is essentially no wear. With this, the service lifetime is increased since the wear on the toothed wheels is significantly reduced. An increase of the operating pressure remains without effect on the wear of the toothed wheel since the axial support of the drive shaft is independent of the magnitude of the operating pressure. The radial support of the drive shaft outside of the pump housing advantageously takes up the forces acting on the drive shaft from outside without a significant effect on the bearing points of the toothed wheels within the pump housing.

To form the supporting bearing, it is proposed to dispose a supporting ring within a supporting housing, where the supporting housing is connected, in such a manner that it is fixed to the pump housing and is penetrated through a bore by the coupling section of the drive shaft. In so doing, the supporting ring is disposed between a diameter step or shoulder on the drive shaft and the supporting housing, where, to fix the supporting ring with respect to the drive shaft, the supporting ring is connected, in such a manner that it is fixed, to the supporting housing.

To form two stop faces for axial and radial support, the supporting ring is advantageously formed with an L-shaped cross section, where an outer circumferential face and an adjoining radial face of the supporting ring lie flush on the supporting housing, and the opposite inner circumferential face and adjoining radial face lie flush on the drive shaft.

To realize a particularly compact form of construction, according to an advantageous embodiment of the invention, a sealing housing is disposed, in such a manner that it is pressure-tight, between the supporting housing and the pump housing. The sealing housing has a through bore, formed so as to be concentric to the coupling section of the drive shaft and the sealing housing encloses a sealing member disposed on the circumferential face of the drive shaft. The housing plates forming the pump housing can thus be aligned, by themselves, to the bearing of the toothed wheels. The sealing member required to seal the drive shaft toward the outside can be formed and configured independently of the bearing.

As sealing means an annular gland and a loading means which acts on the gland are advantageously used. With this, a sealing with respect to high operating pressures within the pump housing can be realized. With this, in particular, return of the respective paint is also possible in order, for example, to initiate a change of paint. For this, the drive shaft can be driven with a varying direction of rotation.

As loading means, several compression springs can advantageously be loaded between the gland and the supporting bearing.

In so doing, it is advantageous that to each of the compression springs within the supporting housing a contact piston is assigned which is aligned with a hole accommodating the springs in such a manner that the springs can be displaced in the loading direction. Thus the loading force acting on the gland can be increased or regenerated after the conclusion of certain periods of operation.

In order to avoid deposits of paints in annular gaps outside of the pump housing due to minimal leakage as the duration of operation increases, according to a preferred embodiment of the invention a shaft sealing ring is disposed within the supporting housing on the circumferential face of the drive shaft and the annular space formed between the sealing member and the shaft sealing ring is filled with a sealing liquid. As sealing liquid, for example, a fluid containing a solvent may be used.

Particularly advantageous is an embodiment of the invention in which the annular space is connected via separate guide ducts to an inlet and an outlet, and where the inlet and the outlet are formed on the sealing housing. With this, the gaps between the drive shaft and the housing parts can be advantageously rinsed out after changing the sealing liquid.

In order to be able to remove the paint remnants contained within the pump housing after a change of paint in as short a time as possible and quickly without any dismounting work, a rinsing duct system is formed within the pump housing, by means of which the gaps formed between the toothed wheels, the shafts, and pump housing can be rinsed.

BRIEF DESCRIPTION OF THE DRAWINGS

The gear pump according to the invention is explained in more detail in the following with the aid of several embodiments with reference to the accompanying figures. In the drawings.

DETAILED DESCRIPTION OF THE PREFERRED EMBODIMENTS

Figure 1:
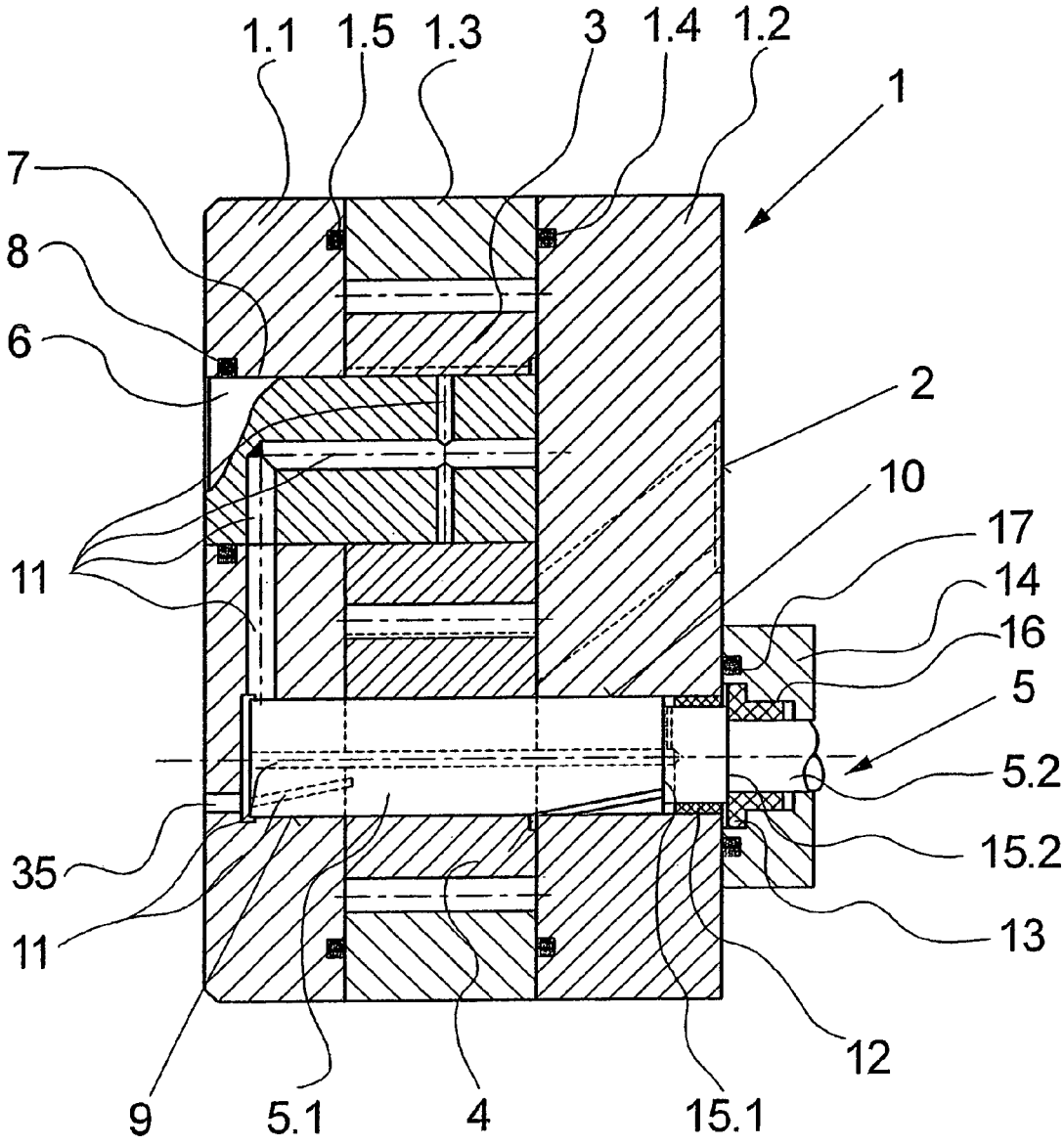
FIG. 1 is a schematic cross-sectional view of a first embodiment of the gear pump according to the invention.

In FIG. 1, a first embodiment of the gear pump according to the invention is represented.

The gear-pump comprises a pump housing 1, which is composed of several parts and comprises the housing plates 1.1 and 1.2 as well as the central plate 1.3 held between the housing plates 1.1 and 1.2. At each of the inner sides of the housing plates 1.1 and 1.2 a respective sealing ring 1.4 and 1.5 is disposed by means of which the gap between the central plate 1.3 and the housing plates 1.1 and 1.2 is sealed toward the outside. The central plate 1.3 comprises recesses for two toothed wheels 3 and 4 meshing in one another. The toothed wheel 3 is mounted on a fixed bearing shaft 6 in such a manner that it can rotate. For this purpose, the bearing shaft 6 is connected to the housing plate 1.1 in an accommodating bore 7 in such a manner that it is fixed. Between the bearing shaft 6 and the housing plate 1.1, a sealing ring 8 is disposed, mounted in an accommodating annular channel in the bore 7.

The second toothed wheel 4 is pressed onto a drive shaft 5. The drive shaft 5 is mounted on the housing plate 1.1 with one free end in a bearing pocket bore 9 so that a bearing gap is formed between the housing plate 1.1 and the drive shaft 5. On the opposite side of the toothed wheel 4, the drive shaft 5 is mounted in the housing plate 1.2 in a penetrating bearing bore 10 in such a manner that it can rotate.

Between the drive shaft 5 and the housing plate 1.2 a sealing member 12 is provided outside of the bearing so that a free coupling section 5.2 of the drive shaft 5 is guided to the drive in such a manner that it is pressure-tight towards the outside. For this, a first diameter step or shoulder 15.1 is formed on the drive shaft 5 within the pump housing 1. Along with this, the bearing section 5.1 of the drive shaft 5 is a part of the drive shaft 5, specifically the part mounted within the pump housing 1. In the housing plate 1.2 a pump inlet and a pump outlet are introduced which are guided in the form of a duct into an inlet chamber or into an outlet chamber (not represented here). The pump inlet and the pump outlet lie in a plane so that only a dotted representation, with the reference number 2, is given in FIG. 1.

Along the operations related inlet and outlet ducts a rinsing system with several rinsing ducts 11 is formed within the pump housing 1 in the housing plates 1.1 and 1.2, as well as within the shafts 5 and 6, in order to supply, from outside via an inlet 35 which is subject to wear, a rinsing agent for rinsing the gaps between the rotating and stationary components within the pump housing. A gear pump of this type is known, for example, from EP 1 164 293 A2 the disclosure of which is incorporated by reference and so that at this point reference is made to the description given there.

On the pump housing 1 a supporting bearing is provided on the drive side of the gear pump. The supporting bearing comprises a supporting housing 14 which is connected to the pump housing 1 in such a manner that it is fixed, and a sealing ring 17 which is disposed between the supporting housing 14 and the pump housing 1 in such a manner that it is concentric to the bearing bore 10.

Within the supporting housing 14 a recess 16 is formed which, on the one hand, makes possible a penetration of the coupling section 5.2 of the drive shaft 5 and, on the other hand, fixes a supporting ring 13 in the radial and axial direction toward the drive side. For this, the supporting ring 13 is formed in the shape of an L and lies flush on a second diameter step or shoulder 15.2 of the drive shaft 5. The supporting ring 13 is preferably made of a plastic and is pressed into the recess 16 of the supporting ring 13 in such a manner that it is fixed. For this, an outer circumferential face of the supporting ring 13 is held without play in an inner diameter of the stepped recess 16. Along with this, a radial face adjoining the outer circumferential face of the supporting ring 13 lies flush on the supporting housing 14. The opposite inner circumferential face and the opposite radial face form the stop face for the drive shaft.

Projecting outside of the supporting housing 14, the end of the coupling section 5.2 of the drive shaft 5 (not represented here) serves to connect a drive, preferably by means of a coupling.

In the operational state, a pigmented lacquer or paint supplied via a pump inlet is conveyed to the pump outlet by turning the toothed wheels 3 and 4 and fed to a painting device's atomizing system, which is directly connected. Along with this, the drive shaft 5 is pressed against the supporting housing 14 due to the pressing action on the free front end of the bearing section 5.1 via the supporting ring 13. By appropriate dimensioning of the gaps and plays it is prevented that the front face of the toothed wheel 4 is pressed against the housing plate 1.2. In addition to this, the forces on the drive shaft 5 directed transversely from outside via the coupling section 5.2 are absorbed via the supporting ring 13 and the supporting housing 14. A deformation or bending of the drive shaft 5 continuing up to the bearing of the pump housing 1 is advantageously avoided. Thus, the embodiment represented in FIG. 1 is particularly suitable to be used in a painting robot. It is, however, also possible to use gear pumps of this type in stationary use in order, for example, to make possible very high operating run times for conveying particularly abrasive pigmented lacquers or paints with high operating pressure.

Figure 2:
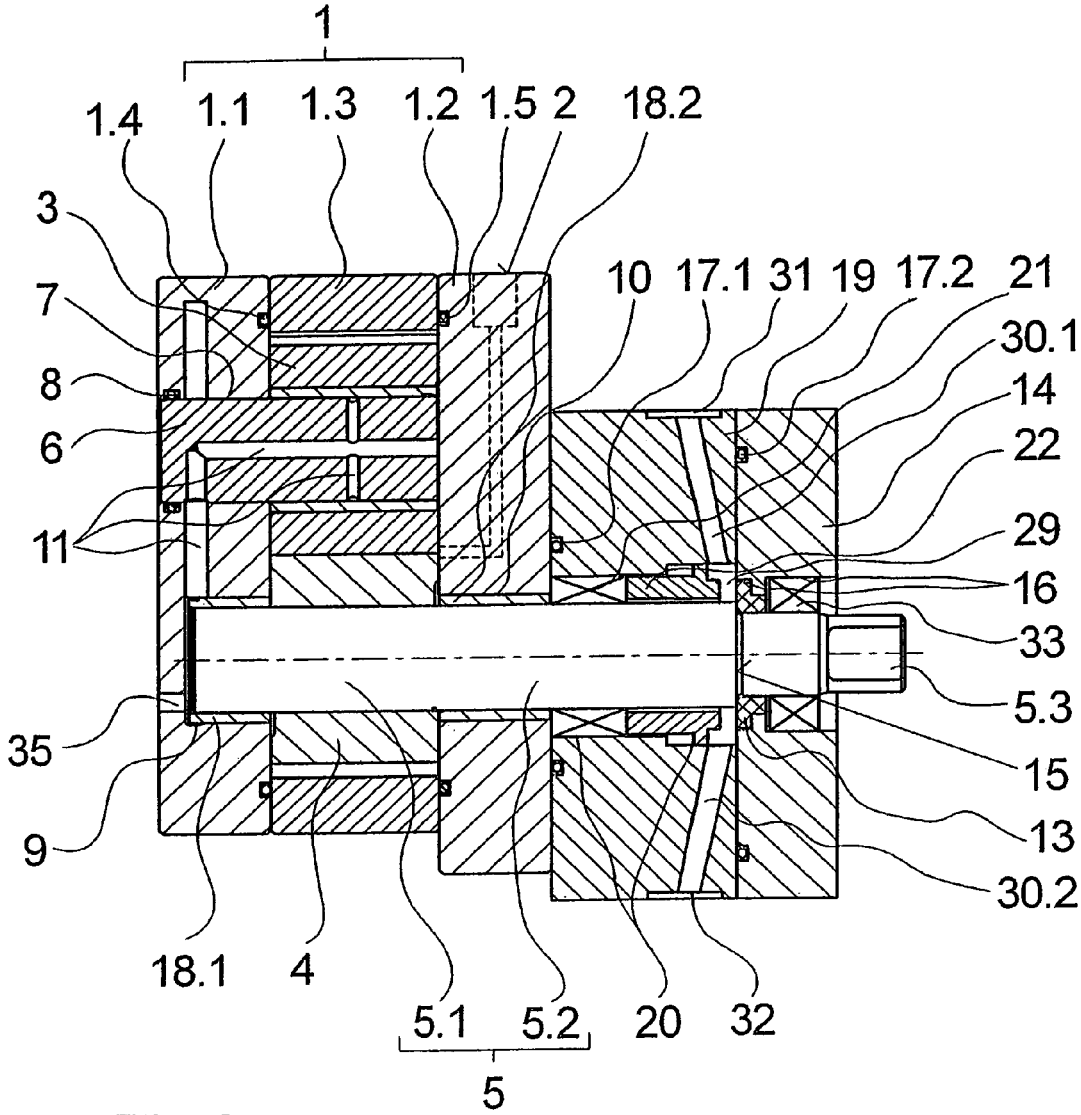
FIG. 2 and FIG. 3 are schematic sectional views of an additional embodiment of the gear pump according to the invention.
Figure 3:
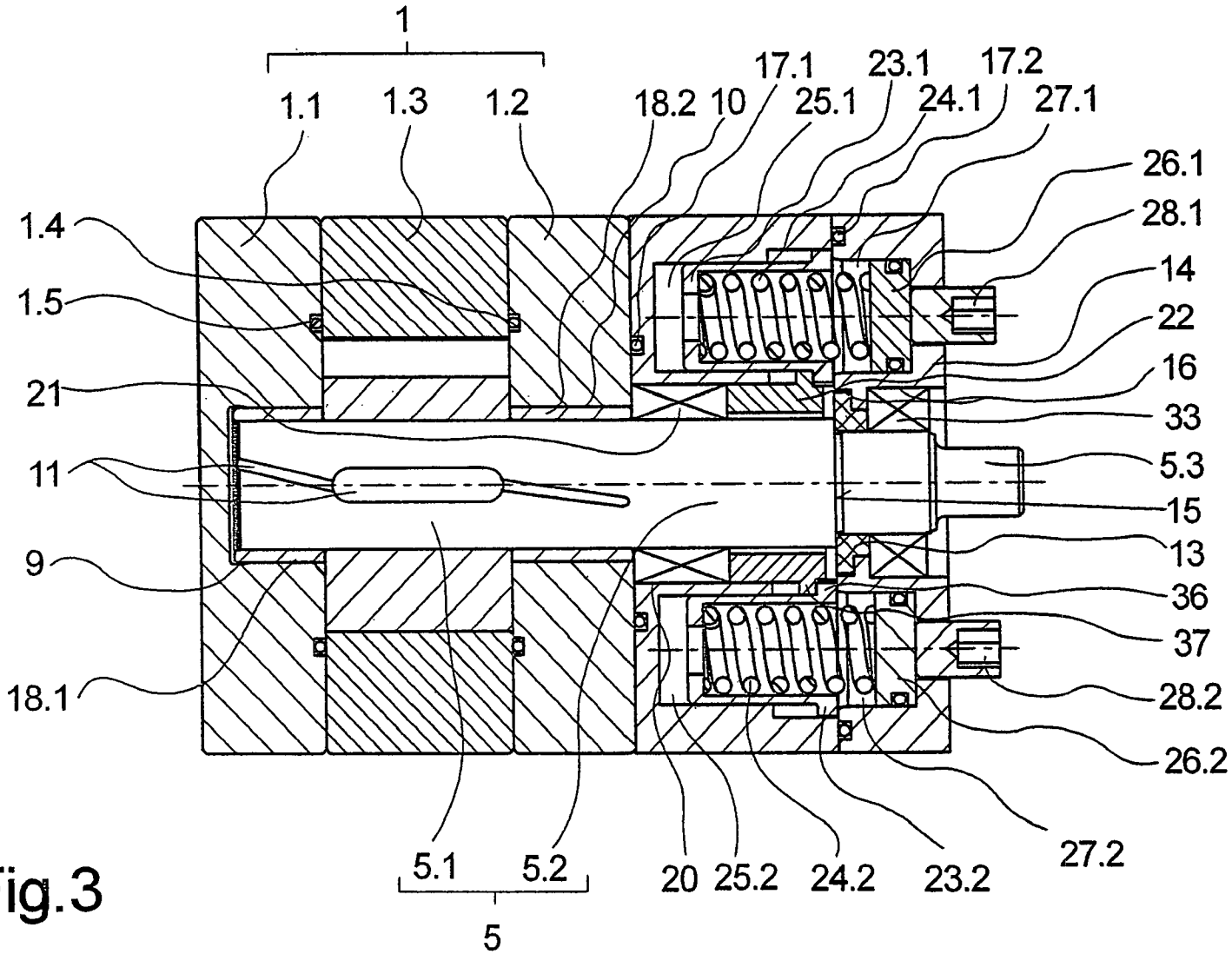

In FIGS. 2 and 3 additional embodiments of the gear pump according to the invention are represented. The following description applies to both figures in so far as no express reference to one of the figures is made. In FIG. 2 the gear pump is represented in a first sectional view of the toothed wheel pairing, and in FIG. 3 a second sectional view of the drive shaft orthogonal to the sectional view in FIG. 2.

In the design of the toothed wheel pairing of the toothed wheels 3 and 4, as well as the pump housing 1, the embodiment is essentially identical to the foregoing embodiment so that at this point reference is made to the aforementioned description.

The drive shaft 5 is mounted, via the bearing bushings 18.1 and 18.2, in the bearing pocket bore 9 in the housing plate 1.1 and the bearing bore 10 of the housing plate 1.2 in such a manner that it can rotate. Between the housing plates 1.1 and 1.2 the driven toothed wheel 4 is fastened on its circumferential face to the bearing section 5.1 of the drive shaft 5. The housing plate 1.1, the central plate 1.3, and the housing plate 1.2 are connected to one another in such a manner that the connection is pressure-tight, where both a pump inlet and a pump outlet (not represented here) are formed on the housing plate 1.2, where the pump inlet and a pump outlet are disposed in a plane and thus only identified in FIG. 2 by the reference number 2.

On the drive side of the pump housing 1 the coupling section 5.2 of the drive shaft 5 projects out of the pump housing 1. The coupling section 5.2 of the drive shaft 5 comprises in its end area a diameter step or shoulder 15, on which a supporting ring 13 lies flush. The supporting ring 13 is L-shaped and is held in a recess 16 of a supporting housing 14. The configuration of the supporting ring 13 and the supporting housing 14 for accommodating the supporting ring 13 are embodied so as to be identical to that of the embodiment according to FIG. 1. Thus, for further description reference is made to the aforementioned embodiment.

The supporting housing 14 is penetrated by the coupling section 5.2 of the drive shaft 5 and one free coupling end 5.3 projects out of the supporting housing 14 to connect a drive. Between the coupling end 5.3 and the shoulder 15, a shaft sealing ring 33 is disposed between the supporting housing 14 and the drive shaft 5. The supporting housing 14 is connected, via a sealing housing 19, to the pump housing 1, in such a manner that the supporting housing is fixed and its connection to the pump housing is pressure-tight. For this purpose, a first sealing ring 17.1 is disposed between the sealing housing 19 and the pump housing 1, and a second sealing ring 17.2 is disposed between the sealing housing 19 and the supporting housing 14. The rings 17.1 and 17.2 are concentric to the bearing bore 10.

The sealing housing 19 comprises a recess 20 formed so as to be concentric to the drive shaft 5, where the recess serves to accommodate a sealing gland 21 disposed on the circumferential face of the drive shaft 5. The gland 21 is supported at an end of sealing housing 19, specifically the end facing the pump housing 1, directly on the housing plate 1.2. On the opposite end of the gland 21 a pressure ring 22 is guided in the sealing housing 19 in such a manner that it is concentric to the drive shaft 5 and can be moved.

As represented in FIG. 3, the pressure ring 22 is pressed against the gland 21 by loading means formed from several compression springs 24.1 and 24.2. For this purpose, several compression springs 24.1 and 24.2 are held by holding cages 23.1 and 23.2 guided in such a manner that they can move in accommodating bores 25.1 and 25.2 of the sealing housing 19. The holding cages 23.1 and 23.2 act with an encircling collar 36 directly on an encircling projection 37 which is formed on the pressure ring 22. Opposite the holding cages 23.1 and 23.2 which are guided in such a manner that they can move, the compression springs 24.1 and 24.2 are guided in spring accommodating bores 27.1 and 27.2 of the supporting housing 14. At the end of the accommodating bores 27.1 and 27.2 contact pistons 26.1 and 26.2 are disposed which can be guided in the spring accommodating bores 27.1 and 27.2 in such a manner that they are pressure-tight. Here the compression springs 24.1 and 24.2 directly abut an adjacent side of the contact pistons 26.1 and 26.2. Acting on the opposite side of the contact pistons 26.1 and 26.2 there is a respective adjustment screw 28.1 and 28.2 by means of which the contact pistons 26.1 and 26.2 can be displaced to adjust an initial spring loading of the gland 21.

In the situation represented in FIG. 3 the initial loading of the gland 21 is applied between the housing plate 1.2 and the supporting housing 14 by a total of two compression springs 24.1 and 24.2. In order to obtain a uniform initial loading, several compression springs can advantageously be formed in the sealing housing 19 in the same manner so that, for example, the gland 21 can be loaded by four, five, or six compression springs.

From the sectional representation in FIG. 2 it furthermore follows that the supporting housing 14 and the annular space 29 formed between the gland 21 and the shaft sealing ring 33 and between the drive shaft 5 and the sealing housing 19 are connected by two ducts 30.1 and 30.2 to an inlet 31 and an outlet 32 respectively. The inlet 31 and the outlet 32 are formed so that they are subject to wear so that in the operational state a sealing liquid is introduced into the sealing housing 19 and fills the annular space 29. In so doing, a solvent-containing fluid is preferably used as sealing liquid in order to dissolve the paint particles within the annular space 29 that may escape due to gap leakage so that hardening in the gap is prevented. In particular, taking into account a subsequent adjustment of the spring loading, the mobility of the pressure ring 22 is ensured. In addition to this, a rinsing of the annular space 29 via the ducts 30.1 and 30.2 and the inlet 31 and the outlet 32 can be carried out in a simple manner during maintenance and replacement of the sealing liquid.

The embodiment represented in FIGS. 2 and 3 of the gear pump according to the invention is particularly suitable for carrying out the dosing of pigmented lacquers or paints with high operating pressures. In particular in the use of gear pumps of this type in painting robots, a return from the gear pump is induced during a change of paint in order to initiate the change of paint. Here higher operating pressures are usually reached, which, however, can be securely borne without danger of a leak due to the pre-loaded gland.

The embodiments represented in FIGS. 1 to 3 of the gear pump according to the invention are exemplary in their design and configuration of the individual components. In principle, the supporting bearings formed outside of the pump house on the drive shaft can be formed by other bearing means customary for radial and axial support. It is important here that there is axial support for the compression forces acting on the drive shaft, so that wear on the driven tooth can be reduced. In addition to this, the radial support of the drive shaft leads to the increase of the bearing service lifetime within the pump housing, where, in particular, a transverse load acting on the drive shaft from outside is reduced.

The invention claimed is:

1. A gear pump for a dosed conveyance of a fluid, comprising a pump housing, a pair of toothed wheels mounted within the pump housing with the toothed wheels being coaxially mounted on a fixed bearing shaft and a drive shaft respectively and so that teeth of the wheels are in meshing engagement, said drive shaft comprising a bearing section which is rotatably mounted at multiple points in the pump housing and a coupling section which extends outside the pump housing and is connected to a drive, and a supporting bearing connected to the outside of the pump housing and supporting the coupling section of the drive shaft in radial and axial directions defined by the drive shaft.

2. The gear pump of claim 1, wherein the drive shaft comprises an outwardly facing shoulder between the bearing section and the coupling section, and the supporting bearing comprises a supporting housing which is fixed to the outside of the pump housing and which includes a bore through which the coupling section of the drive shaft extends, and the supporting bearing further comprises a supporting ring disposed in a recess of the bore of the supporting housing so as to be supported against the shoulder of the drive shaft.

3. The gear pump of claim 2, wherein the recess of the supporting housing has an L-shaped cross section which defines an inner circumferential face and an adjoining radial face, and wherein the supporting ring has a conforming cross section and defines an outer circumferential face and an adjoining radial face which lie against the inner circumferential face and the adjoining radial face of the recess respectively.

4. The gear pump of claim 1 further comprising a sealing housing disposed between the supporting bearing and the pump housing in a pressure tight manner, with the drive shaft extending through a bore in the sealing housing and with a sealing member disposed between the bore of the sealing housing and the drive shaft.

5. The gear pump of claim 4, wherein the sealing member comprises an annular gland and a loading means acting axially on the gland.

6. The gear pump of claim 5, wherein the loading means comprises a plurality of compression springs which are biased between the gland and the supporting bearing.

7. The gear pump of claim 6, wherein the loading means further comprises a pressure ring disposed coaxially on the drive shaft and adjacent said annular gland, and wherein the compression springs are accommodated in respective cylindrical holding cages, with the cages being guided in respective accommodating holes in the sealing housing in such a manner that the cages can engage the pressure ring to bias the pressure ring against the annular gland.

8. The gear pump of claim 7, wherein the loading means further comprises a contact piston mounted in the supporting bearing and associated with each of the compression springs and to permit the loading thereof to be controlled.

9. The gear pump of claim 4, wherein the drive shaft defines an outer circumference within the supporting bearing, and wherein the supporting bearing further comprises a shaft sealing ring disposed about the outer circumference of the drive shaft, and such that an annular space is defined between the sealing member in the sealing housing and the shaft sealing ring.

10. The gear pump of claim 9, wherein the annular space is connected via separate ducts to an inlet and an outlet which are formed on the sealing housing, and such that the annular space can be filled with a rinsing liquid.

11. The gear pump of claim 1, further comprising a rinsing duct system formed within the pump housing for rinsing of gaps between the toothed wheels, the bearing shaft and driven shaft, and the pump housing.

12. The gear pump of claim 3, wherein the supporting ring further has a radial end face which faces opposite from said adjoining radial face of said supporting ring and which abuts the shoulder of the drive shaft.

* * * * *